United States Patent [19]

Salak

[11] 4,404,885

[45] Sep. 20, 1983

[54] MICROPHONE MOUNT FOR BASS FIDDLE

[76] Inventor: Scott W. Salak, 26151 Lakeshore Blvd., Euclid, Ohio 44132

[21] Appl. No.: 250,580

[22] Filed: Apr. 3, 1981

[51] Int. Cl.[3] ..... G10D 3/00; G12B 9/00

[52] U.S. Cl. ..... 84/329; 84/1.14; 84/1.04; 84/DIG. 3; 248/27.1; 248/231.1

[58] Field of Search ..... 84/1.04, 1.16, 1.14, 84/329, 469; 248/27.1, 56, 231.1

[56] References Cited

U.S. PATENT DOCUMENTS

| | | | |
|---|---|---|---|
| 2,430,717 | 11/1947 | Hull | 84/1.16 |
| 2,725,778 | 12/1955 | Cronwell | 84/1.16 |
| 3,161,392 | 12/1964 | Kopec et al. | 248/104 |
| 3,901,188 | 8/1975 | Ford | 84/1.16 |
| 4,037,229 | 7/1977 | Dunk | 343/715 |
| 4,168,647 | 9/1979 | Petillo | 84/1.14 |
| 4,227,434 | 10/1980 | DiMarzio | 84/1.16 |

*Primary Examiner*—F. W. Isen

*Attorney, Agent, or Firm*—David A. Burge Co.

[57] ABSTRACT

The present invention relates to a simple and inexpensive, clamp-type microphone mount for base fiddles and the like. The mount includes at least a pair of members arranged to clampingly engage such portions of a musical instrument as defined opposite sides of an aperture formed through the housing of the instrument.

7 Claims, 8 Drawing Figures

MICROPHONE MOUNT FOR BASS FIDDLE

BACKGROUND OF THE INVENTION

1. Field of the Invention

The present invention relates generally to a microphone mount for supporting a microphone adjacent an aperture formed through the housing of a musical instrument and, more particularly, to a clamp-type microphone mount particularly well suited for use with bass fiddles.

2. Prior Art

While the need for positioning a microphone adjacent to a musical instrument to receive sounds produced by the instrument has long been appreciated, previously proposed microphone mounts have not been well suited for use with such instruments with bass fiddles.

Inasmuch as a musician tends to move a bass fiddle about during a performance, it is desirable to support the microphone directly on the instrument itself in order to keep constant the relative positions of the microphone's pickup head and the instrument, so long as doing this does not interfere with the performance of the instrument. Previously proposed microphone mounts have been characterized by such drawbacks as interferring with the character of the sound produced by the instrument on which they are mounted, failing to provide a sufficiently stable and dependable support, and/or comprising an unduly heavy, unduly complex structure which is expensive to fabricate and difficult to use.

SUMMARY OF THE INVENTION

The present invention overcomes the foregoing and other drawbacks of prior proposals by providing a novel and improved clamp-type microphone mount which is especially well suited for use with such instruments as bass fiddles which have slot-like openings formed through their housings.

The applicant has found that the most appropriate place to position a microphone for use with a bass fiddle is adjacent the "F" hole formed through the housing of the instrument. In accordance with the present invention, a novel and improved, lightweight, simply configured, clamp-type microphone mount is provided which can be secured to such portions of a bass fiddle as extend along opposite sides of the "F" hole of the instrument. The lightweight character of the mount, and the resilient manner in which it clampingly engages the instrument, enable the mount to be installed quite securely on the instrument adjacent the "F" hole of the instrument without inhibiting proper performance of the instrument.

In accordance with the preferred practice of the present invention, a clamp-type microphone support is provided which has a pair of members, at least one of which is configured to extend across an aperture formed through the housing of a musical instrument. The members are operative to engage portions of the housing which define opposite sides of the aperture. Clamping means are provided for moving the members relatively toward and away from each other to clamp the members against the housing portions. The mount carries a projection or other formation which is threaded or otherwise suitably configured to receive a standard thread or other formation characteristically found on microphone brackets, whereby a microphone can be attached quite easily to the mount by coupling the mount with the microphone's bracket.

A feature of the invention lies in the capability of a mount embodying the invention to very securely support a microphone despite the simplicity of the mount's configuration. A further feature lies in the ease with which the mount can be installed onto and removed from such instruments as a bass fiddle.

These and other features and a fuller understanding of the present invention may be had by referring to the following detailed description and claims taken in conjunction with the accompanying drawings.

DESCRIPTION OF THE PREFERRED EMBODIMENT

Figure 1:
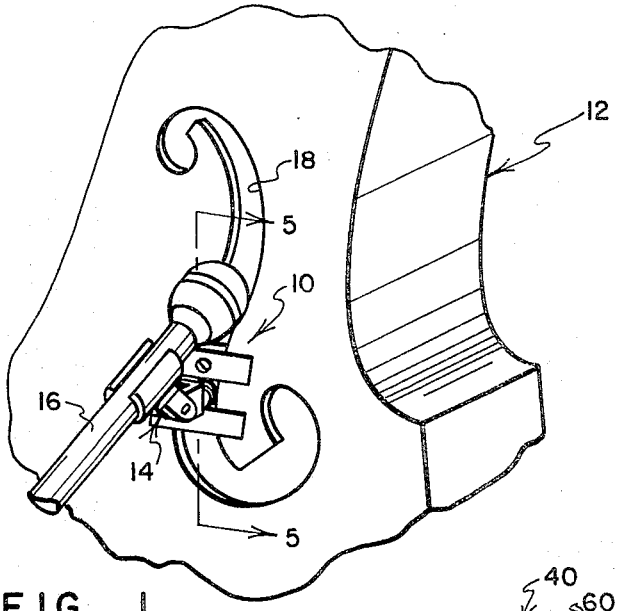
FIG. 1 is a perspective view of portions of a bass fiddle having a microphone mount embodying features of the present invention secured thereto and carrying a bracket-supported microphone positioned adjacent the "F" hole of the bass fiddle.
Figure 2:
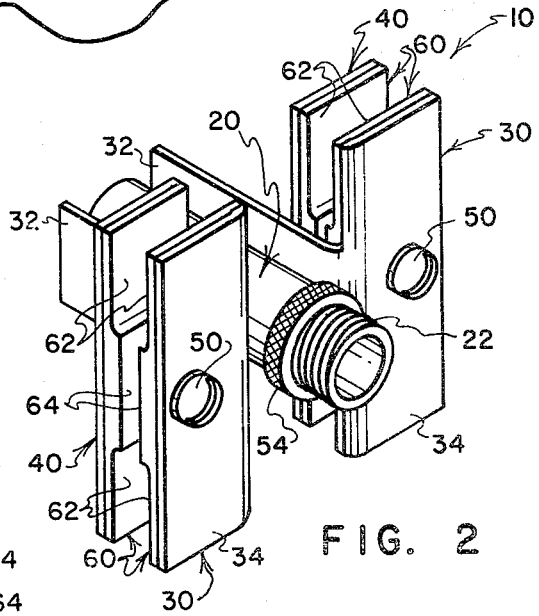
FIG. 2 is a perspective view, on an enlarged scale, of the microphone mount of FIG. 1.
Figure 3:
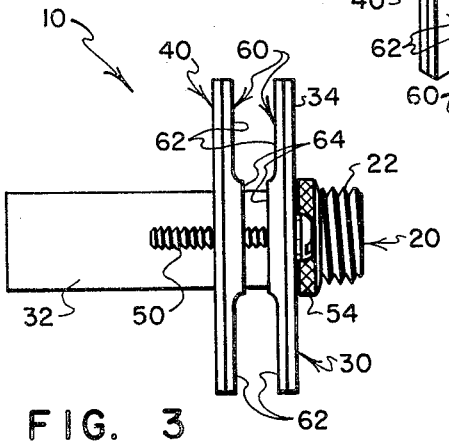
FIG. 3 is a top plan view of the microphone mount of FIG. 1.
Figure 4:
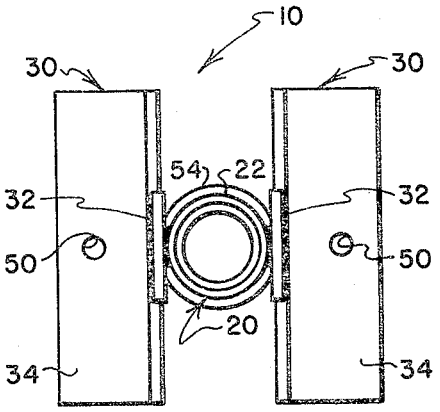
FIG. 4 is a rear side elevational view of the microphone mount of FIG. 1.

Referring to FIGS. 1–4, one form of microphone mount embodying features of the present invention is indicated generally by the numeral 10. In FIG. 1, the mount 10 is shown in position on a bass fiddle indicated generally by the numeral 12. The mount 10 is shown supporting a conventionally configured microphone bracket 14 which carries a conventionally configured microphone 16. The bass fiddle 12 has what is known as an "F" hole 18 formed through the front face of its housing.

Referring to FIGS. 2–6, the microphone mount 10 includes a tubular member indicated generally by the numeral 20. The member 20 has a threaded outer end portion 22 which carries a standard thread configured to receive the standard thread of a conventionally configured microphone support bracket such as the bracket 14. Flanking opposite sides of the tubular member 20 are a pair of substantially T-shaped strap-like members 30. The members 30 have parallel stem portions 32 extending along and rigidly secured to the tubular member 20 as by welding or other suitable fastening techniques. The members 30 have bar portions 34 bent out of the planes of the stem portions 32 and extending in a common plane which parallels the front face of the bass fiddle 12 when the mount 10 is in place on the fiddle 12.

A pair of clamping members 40 are positioned behind the bar portions 34 and extend parallel to the bar portions 34 at locations spaced rearwardly therefrom. The clamping members 40 are arranged to extend in a common plane which parallels the plane of the bar portions 40. In essence, the bar portions 34 bridge the opening 18 and overlie front surface portions of the housing of the fiddle while the clamping members 40 also bridge the opening 18 but underlie the housing portions.

Figure 5:
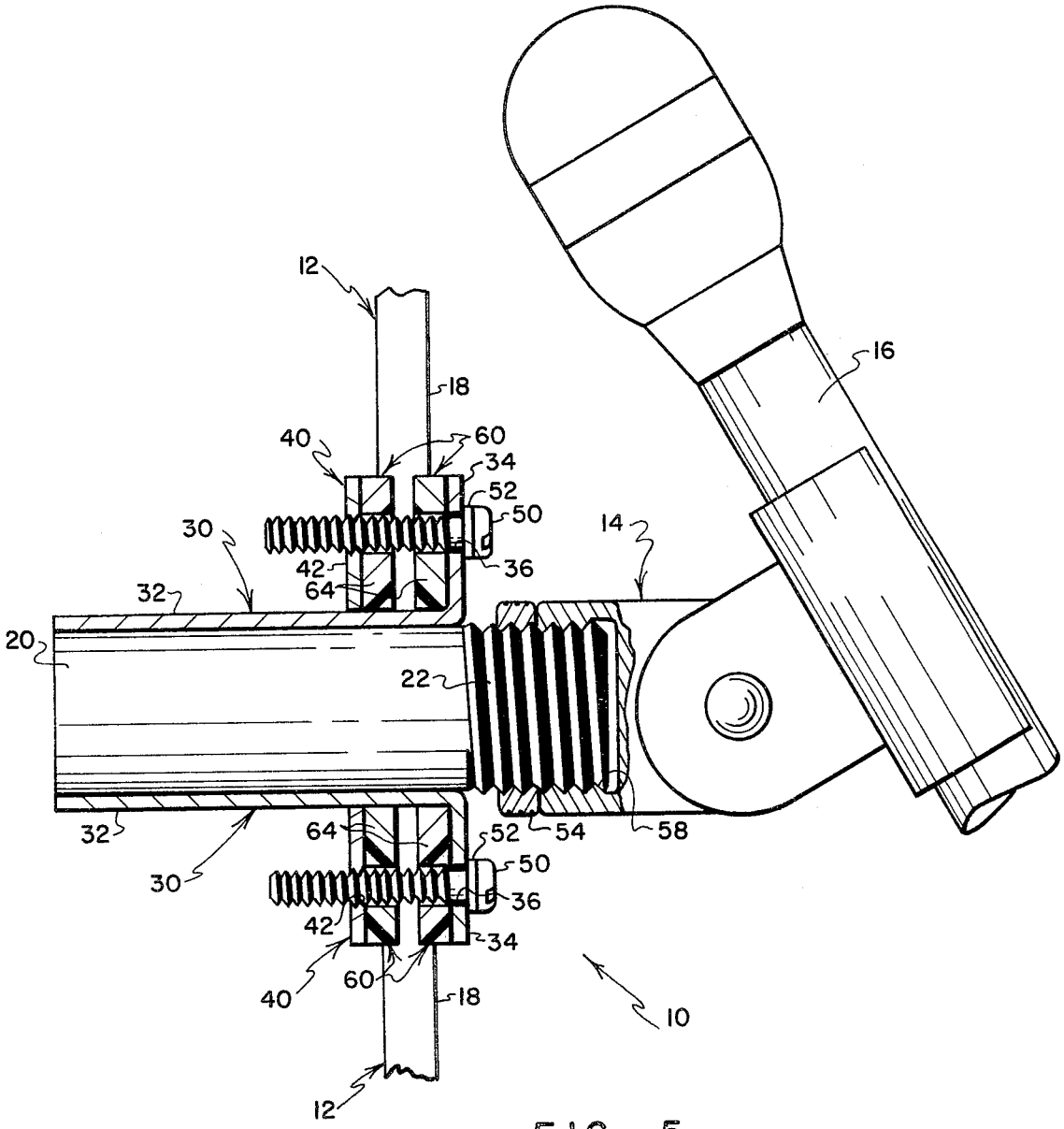
FIG. 5 is a sectional view, on an enlarged scale, as seen from a plane indicated by a line 5—5 in FIG. 1.

Threaded fasteners 50 extend through aligned holes formed in associated pairs of the bar portions 34 and clamping members 40. As is best seen in FIG. 5, these aligned holes include unthreaded holes 36 formed through the bar portions 34, and threaded holes 42 formed through the clamping members 40. Lock washers 52 are carried adjacent the heads of the threaded fasteners 50. The lock washers 52 assist in retaining the fasteners 50 in place once the fasteners 50 have been tightened to bring the bar portions 34 and the clamping members 40 into clamping engagement with such portions of the housing of the bass fiddle 12 as lie on opposite sides of the "F" hole 18.

The microphone mount 10 of FIGS. 1–6 may be readily attached to the bass fiddle 12 by first positioning the clamping members 40 inside the housing of the bass fiddle 12 so that they extend across the "F" opening 18. The remainder of the mount 10 is then positioned such that the stem members 32 and the cylindrical portion 22 extend into the "F" hole 18 at a location between the clamping members 40, and such that the bar portions 34 extend in overlying relationship with the clamping members 40. Once these components of the mount have been positioned as described, the threaded fasteners 50 are then installed in the holes 36, 42 and are tightened to bring the clamping members 40 and bar portions 34 into clamping engagement with opposite sides of such portions of the base fiddle 12 as define opposite sides of the "F" opening 18.

A knurled nut 54 is carried on the threaded portion 22 of the tubular member 20 for tightening against the microphone bracket 14 to retain the microphone bracket 14 in place in a desired attitude relative to the instrument 12. Referring to FIG. 5, it will be seen that the bracket 14 has an interiorly threaded portion 58 which is threaded onto the tubular member 20.

Figure 6:
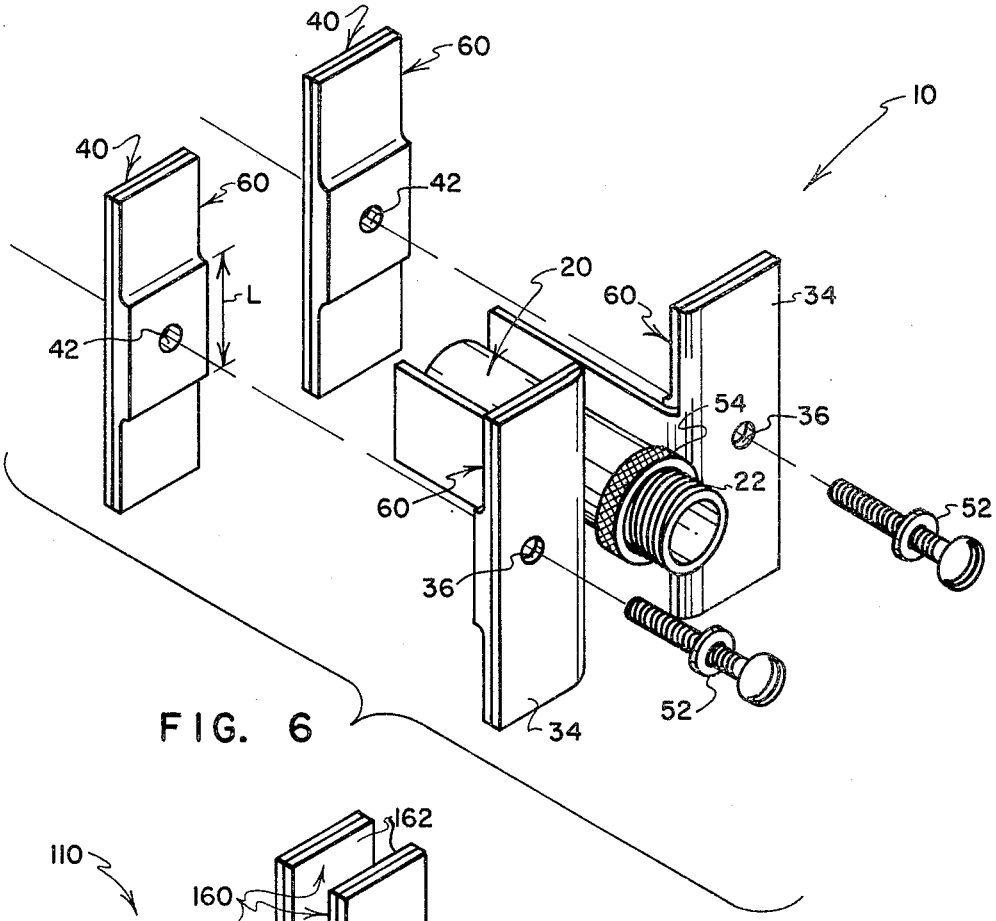
FIG. 6 is an exploded perspective view of the microphone mount of FIG. 1.

In preferred practice, the bar portions 34 and the clamping members 40 each carry resilient cushions 60 on such surfaces as are brought into clamping engagement with the housing of the bass fiddle 12. The resilient cushions 60 preferably takes the form of an elastomeric material such as soft foam rubber which is adhered to the bar portions 34 and to the clamping members 40. The resilient cushions 60 preferably have end portions 62 of reduced thickness and central portions 64 of enhanced thickness. The lengths of the central portions 64, as indicated generally by the letter L in FIG. 6, is preferably selected such that is corresponds to the width of the portion of the "F" hole 18 adjacent which the microphone mount 10 will be installed. By this arrangement the central portions 64 of the elastomeric cushions 60 extends into the "F" hole 18 and engage opposed surfaces of the housing which define opposite sides of the "F" hole 18 so as to assist in maintaining the proper orientation of the bar portions 34 and the clamping members 40 relative to the housing of the instrument 14.

Figure 7:
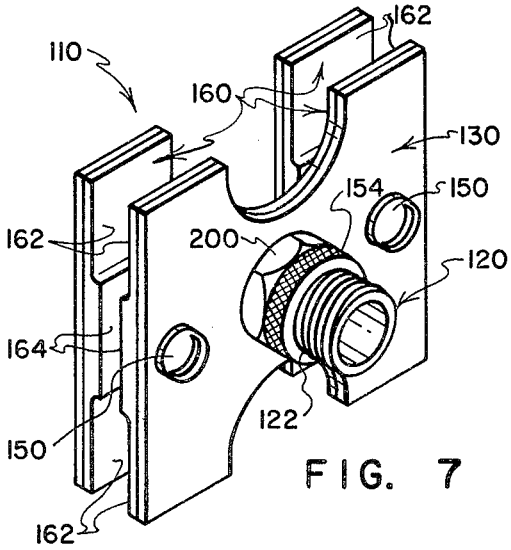
FIG. 7 is a perspective view, similar to FIG. 2, of an alternative form of microphone mount embodying features of the invention; and, FIG. 8 is a top plan view, similar to FIG. 3 of the microphone mount of FIG. 7.
Figure 8:
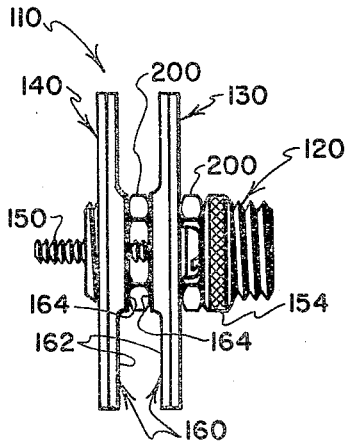

Referring to FIG. 7, an alternate embodiment of microphone mount which incorporates features of the present invention is indicated generally by the numeral 110. The mount 110 differs from the mount 10 in that a plate member 130 is substituted for the T-shape structures 30. A microphone connector formation in the form of a tubular member 120 extends through a hole located centrally in the plate member 130 and is secured to the plate member by a pair of nuts 200 which engage opposite sides of the plate member 130. The tubular member 120 is shorter than the tubular member 20 employed in the mount 10. An advantage of the mount 110 over the mount 10 is that the mount 110 is lighter in weight and less expensive to fabricate. Inasmuch as other parts of the mount 110 are identical in function to those of the described mount 10, they need not be described here in detail. Corresponding parts of the mounts 110, 10 are indicated in the drawings by numerals which differ in magnitude by a value of one hundred.

As will be apparent from the foregoing description, the present invention provides a simple and inexpensive clamp-type microphone mount which can be utilized with instruments such as bass fiddles which have openings formed through their housings. The mount of the present invention has been found to be particularly well suited for use with bass fiddles inasmuch as the optimum location for supporting a microphone for proper pick-up of the performance of a bass fiddle has been determined to be at a location adjacent the "F" hole of the instrument. A feature of the mount of the present invention is that it clampingly engages only a relatively small portion of the housing of the instrument thereby minimizing any detrimental effect on the performance of the instrument. Moreover, the resilient cushions carried by the mount permit housing portions of the instrument to resinate in their ordinary manner further diminishing the detrimental effect of the mount on the performance of the instrument.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A microphone mount for positioning a microphone in steadied and non-shifting relationship adjacent an opening formed through a substantially planar wall of a housing of a musical instrument subjected to musical vibration and without imparting vibration-induced mechanical noise from said mount to a microphone, comprising:

(a) clamping means for sandwiching and clampingly engaging exterior and interior portions of a substantially planar wall of a musical instrument, said instrument wall portions being located on opposite sides of an opening formed through the instrument planar wall, the clamping means including:

(i) at least a pair of overlying clamping members with each member of sufficient length to extend transversely across the opening formed through the instrument planar wall to overlie said planar wall portions on either side of said opening, with at least one of said clamping members having dimensions to permit ready insertion thereof through the opening in the instrument;

(ii) resilient cushion means carried by said clamping members on the respective faces thereof confronting said instrument wall portions;

(iii) compression means accessible from one side of said clamping members and adjacent an exterior wall of the instrument for effecting relative movement of the clamping members in directions substantially perpendicular to said instrument wall portions to bring the clamping members into clamping engagement with said instrument wall portions; and, (b) microphone connector means carried by at least one of the clamping members for supporting a microphone rigidly adjacent said instrument when the mount is clamped thereon, said connector means extending outwardly from said one side of said clamping members exteriorly of said instrument wall thereby to position a microphone in proximity to said instrument wall, whereby a microphone may be readily mounted in secure relation in immediate proximity to an exterior face said musical instrument when said mount is clamped thereon and wherein said resilient cushion means in cooperation with said compression means preclude unwanted shifting movement of said mount in response to musical instrument vibration while simultaneously precluding transmission of noise-inducing vibration to said clamping members, said microphone connector means, and a microphone thereon.

2. The microphone mount of claim 1 wherein the microphone connector means includes a threaded projection configured to receive standard threads formed on a conventional microphone mounting bracket.

3. The microphone mount of claim 1 wherein the compression means includes at least one threaded fastener extending through aligned holes formed in the overlying clamping members.

4. The microphone mount of claim 1 further including a pair of said clamping means disposed respectively on either side laterally of said microphone connector means, thereby to rigidify further the clamping attachment to said instrument.

5. The microphone mount of claim 4 wherein each said compression means is associated with a separate pair of said clamping members.

6. The microphone mount of claim 4 wherein said microphone connector means includes portions extending within said housing opening when the mount is clamped on said instrument.

7. The microphone mount of claim 1 wherein the structure includes a pair of generally T-shaped members and the microphone connector means includes a threaded structure secured to the T-shaped members.

* * * * *